US010316869B2

(12) United States Patent
Kubota et al.

(10) Patent No.: US 10,316,869 B2
(45) Date of Patent: Jun. 11, 2019

(54) SINGLE-ACTING HYDRAULIC CYLINDER

(71) Applicant: KYB Corporation, Tokyo (JP)

(72) Inventors: Takuya Kubota, Gifu (JP); Daisuke Sueyoshi, Gifu (JP)

(73) Assignee: KYB Corporation, Tokyo (JP)

( * ) Notice: Subject to any disclaimer, the term of this patent is extended or adjusted under 35 U.S.C. 154(b) by 99 days.

(21) Appl. No.: 15/559,821

(22) PCT Filed: Mar. 7, 2016

(86) PCT No.: PCT/JP2016/057006

§ 371 (c)(1),
(2) Date: Sep. 19, 2017

(87) PCT Pub. No.: WO2016/152482

PCT Pub. Date: Sep. 29, 2016

(65) Prior Publication Data

US 2018/0051722 A1 Feb. 22, 2018

(30) Foreign Application Priority Data

Mar. 20, 2015 (JP) ..... 2015-058144

(51) Int. Cl.
*F01B 31/10* (2006.01)
*F15B 15/14* (2006.01)

(52) U.S. Cl.
CPC ..... *F15B 15/1428* (2013.01); *F15B 15/1433* (2013.01); *F15B 15/1461* (2013.01); *F15B 15/149* (2013.01); *F15B 2211/7052* (2013.01)

(58) Field of Classification Search
CPC ..... F15B 15/1433; F15B 15/1461; F15B 15/1442; F04B 27/109; F16J 1/08
USPC ..... 92/153
See application file for complete search history.

(56) References Cited

U.S. PATENT DOCUMENTS 2,893,353 A * 7/1959 Short, Jr. ..... F15B 11/123 92/51
4,076,103 A * 2/1978 Wallis ..... F16F 9/3278 92/153
5,052,278 A * 10/1991 Smillie, III ..... F16J 15/162 92/153
5,086,691 A * 2/1992 von Hatten ..... F16F 9/365 92/153
6,681,682 B2 * 1/2004 Niwa ..... F15B 15/1433 92/153
9,988,793 B2 * 6/2018 Dauderman ..... F15B 15/1461
2001/0047719 A1 12/2001 Niwa et al.

FOREIGN PATENT DOCUMENTS

CN 104006023 A 8/2014
JP S60-121508 U 8/1985
JP 2001-200810 A 7/2001

* cited by examiner

*Primary Examiner* — Michael Leslie
(74) *Attorney, Agent, or Firm* — Rabin & Berdo, P.C.

(57) ABSTRACT

A single-acting hydraulic cylinder includes a cylinder head provided in the opening of the cylinder tube to allow the piston rod to be inserted, a bushing provided on an inner circumference of the cylinder head to slidably support the piston rod, and a housing recessed portion formed on the inner circumference of the cylinder head to receive the bushing forcibly inserted from the inlet portion. A bottom clearance filled with the grease is formed between the bottom face of the housing recessed portion and the bushing.

16 Claims, 7 Drawing Sheets

SINGLE-ACTING HYDRAULIC CYLINDER

TECHNICAL FIELD

The present invention relates to a single-acting hydraulic cylinder.

BACKGROUND ART

JP2001-200810A discusses a single-acting hydraulic cylinder including a piston rod inserted into a cylinder tube having a bottomed cylindrical shape, a piston provided in a tip of the piston rod to partition an inside of the cylinder tube into a rod-side chamber and a bottom-side chamber, and a cylinder head provided in an opening of the cylinder tube to slidably support the piston rod. In the single-acting hydraulic cylinder discussed in JP2001-200810A, the rod-side chamber is an air chamber.

SUMMARY OF INVENTION

In general, in the single-acting hydraulic cylinder in which the air is filled in the rod-side chamber, in order to reduce a sliding friction of the piston rod, a lubricant is filled in an inner circumference of the cylinder head.

In the single-acting hydraulic cylinder discussed in JP2001-200810A, the cylinder head has a bushing that slidably supports the piston rod and a lubricant filled in an inner circumferential groove formed on the inner circumference of the cylinder head. In this manner, in the single-acting hydraulic cylinder discussed in JP2001-200810A, lubricity between the piston rod and the bushing is secured by filling the lubricant in the inner side of the cylinder head.

However, it is difficult to fabricate such a groove formed on the inner circumference of the cylinder head. For this reason, in the single-acting hydraulic cylinder discussed in JP2001-200810A, producibility may be degraded.

An object of the present invention is to improve producibility of the single-acting hydraulic cylinder.

According to one aspect of the present invention, a single-acting hydraulic cylinder includes a cylinder tube having a bottomed cylindrical shape provided with an opening in one end; a piston rod inserted into the cylinder tube; a piston connected to a tip of the piston rod to partition an inside of the cylinder tube into a rod-side chamber in which a gas is filled and a bottom-side chamber in which an actuating liquid is supplied or discharged; a cylinder head provided in the opening of the cylinder tube to allow the piston rod to be inserted; a bushing installed on an inner circumference of the cylinder head to slidably support the piston rod; a housing recessed portion formed on the inner circumference of the cylinder head to allow the bushing to be inserted from an inlet portion; and a main seal provided on the inner circumference of the cylinder head, the main seal being sliding contact with an outer circumferential surface of the piston rod to seal the rod-side chamber. A bottom clearance filled with a lubricant material is formed between a bottom face of the housing recessed portion and the bushing. The bottom clearance is provided in the rod-side chamber side relative to the main seal.

DESCRIPTION OF EMBODIMENTS

<First Embodiment>

A single-acting hydraulic cylinder 100 according to a first embodiment of the invention will now be described with reference to the accompanying drawings. Hereinafter, the single-acting hydraulic cylinder 100 will be simply referred to as a "hydraulic cylinder 100."

Figure 1:
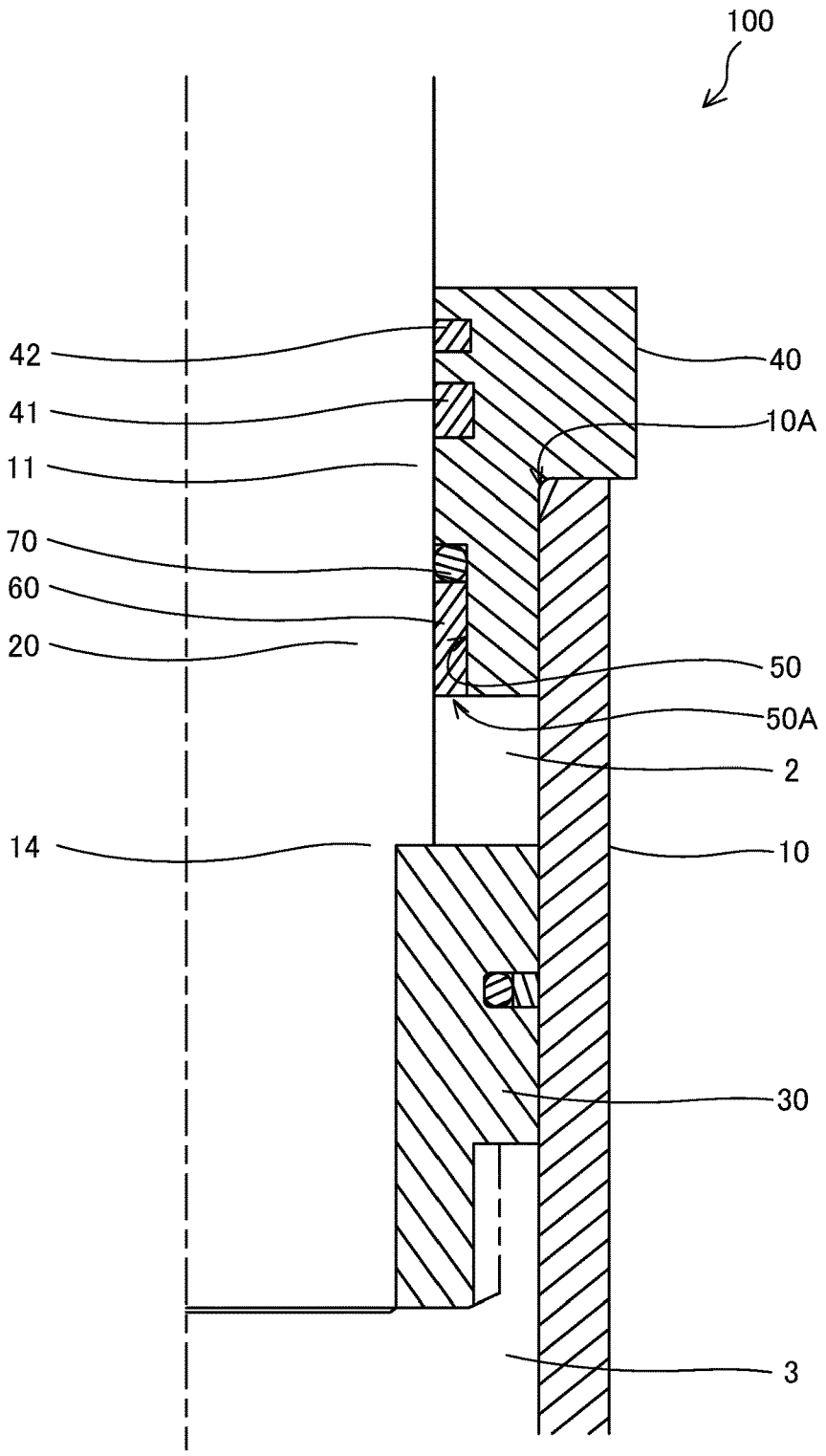
FIG. 1 is a cross-sectional view partially illustrating a hydraulic cylinder according to a first embodiment of the invention.

As illustrated in FIG. 1, the hydraulic cylinder 100 includes a cylinder tube 10 having a bottomed cylindrical shape and an opening 10A provided in its one end, a piston rod 20 inserted into the cylinder tube 10, a piston 30 connected to a tip of the piston rod 20 to partition an inside of the cylinder tube 10 into a rod-side chamber 2 and a bottom-side chamber 3, and a cylinder head 40 provided in the opening 10A of the cylinder tube 10 to allow the piston rod 20 to be inserted.

The hydraulic cylinder 100 is used as a lift cylinder for lifting or lowering a load of a forklift. The cylinder tube 10 of the hydraulic cylinder 100 is connected to a chassis (not shown) of the forklift, and the piston rod 20 is connected to a fork (not shown) used to place the load. The hydraulic cylinder 100 is mounted on the chassis of the forklift such that its center axis extends in a vertical direction. The fork is lifted or lowered by expanding or contracting the hydraulic cylinder 100.

A gas is filled in the rod-side chamber 2 of the cylinder tube 10, and a hydraulic fluid as an actuating liquid is supplied to or discharged from the bottom-side chamber 3. The hydraulic cylinder 100 is expanded by an actuating hydraulic pressure guided from a hydraulic pressure source (actuating liquid pressure source) to the bottom-side chamber 3. As the actuating hydraulic pressure of the bottom-side chamber 3 decreases, the piston rod 20 and the piston 30 move downward by their self-weights, so that the hydraulic cylinder 100 is contracted.

The cylinder head 40 is fixed to the cylinder tube 10. A main seal 41 and a dust seal 42 are inserted into the inner circumference of the cylinder head 40.

The main seal 41 makes sliding contact with an outer circumferential surface of the piston rod 20 to seal the rod-side chamber 2 of the cylinder tube 10. The dust seal 42 prevents dust from intruding into the cylinder tube 10.

Here, in order to facilitate understanding of the hydraulic cylinder 100, the hydraulic cylinder 600 as a comparison example will be described with reference to FIG. 7. Like reference numerals denote like elements as in the hydraulic cylinder 100.

Figure 7:
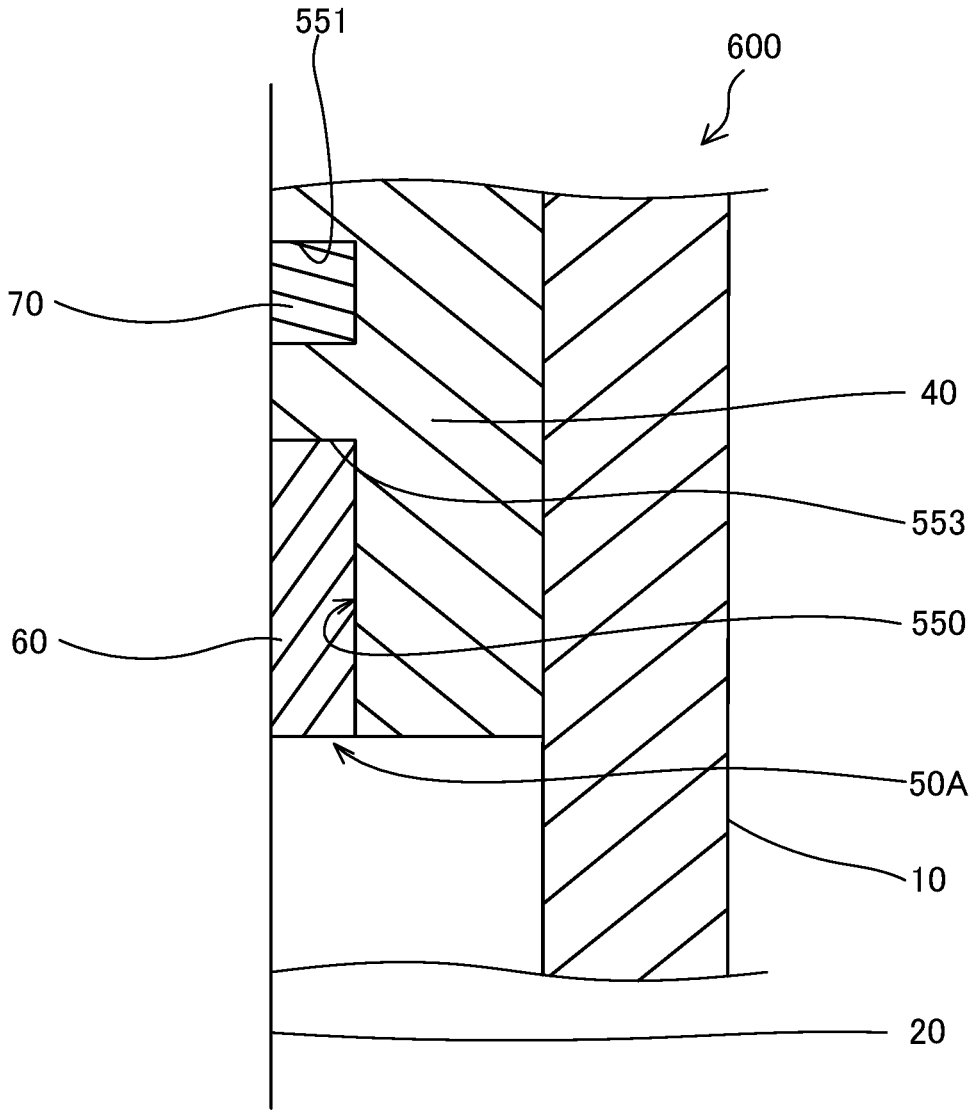
FIG. 7 is a cross-sectional view illustrating a bushing and a housing recessed portion of a hydraulic cylinder in a comparison example of the present invention.

As illustrated in FIG. 7, the hydraulic cylinder 600 includes an annular bushing 60 provided on the inner circumference of the cylinder head 40 to slidably support the piston rod 20, a housing recessed portion 550 formed on the inner circumference of the cylinder head 40 to receive the bushing 60 forcibly inserted, and a grease reserving groove 551 formed on the inner circumference of the cylinder head 40 to reserve grease 70 as a lubricant material. As the bushing 60 makes sliding contact with an outer circumferential surface of the piston rod 20, the piston rod 20 is supported so as to move along an axial direction of the cylinder tube 10. The bushing 60 is a so-called metal bushing formed of metal.

The bushing 60 is inserted from an inlet portion 50A of the housing recessed portion 550 and is forcibly inserted to the housing recessed portion 550 until it abuts on a bottom portion 553.

The grease reserving groove 551 is formed apart from the housing recessed portion 550 in an axial direction. The grease 70 is filled in the grease reserving groove 551. As the grease 70 is filled in the grease reserving groove 551 on the inner circumference of the cylinder head 40, the sliding surface between the piston rod 20 and the bushing 60 is lubricated, so that the piston rod 20 can smoothly slide.

However, in the hydraulic cylinder 600, it is necessary to separately form, on the inner circumference of the cylinder head 40, the housing recessed portion 550 where the bushing 60 is forcibly inserted and the grease reserving groove 551 where the grease 70 is filled. The grease reserving groove 551 is not opened on an end face of the cylinder head 40, but is opened only on the inner circumference surface of the cylinder head 40. For this reason, it is particularly difficult to fabricate the grease reserving groove 551, fabrication accuracy is easily degraded, and burrs may be easily formed. For this reason, producibility may be degraded in the hydraulic cylinder 600.

Figure 2:
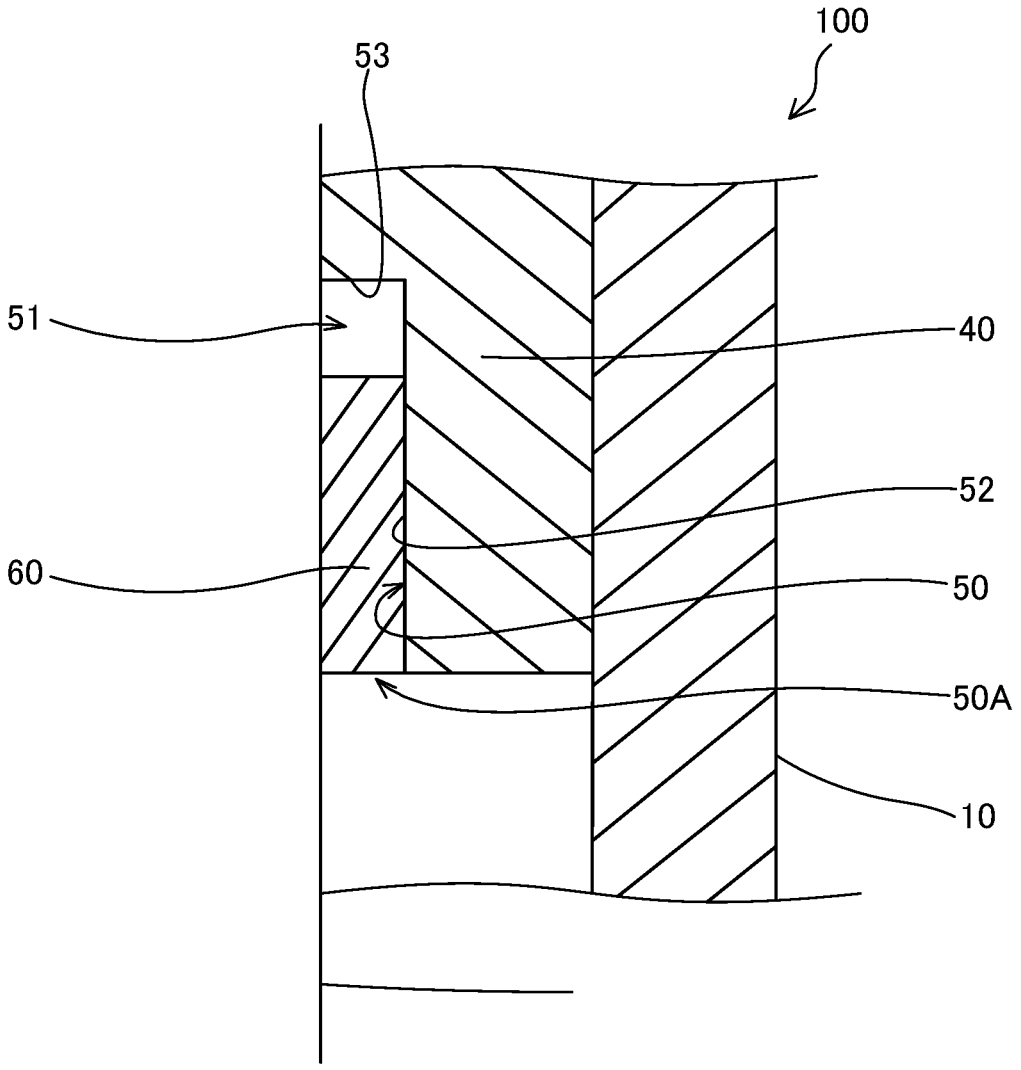
FIG. 2 is a cross-sectional view illustrating a bushing and a housing recessed portion of the hydraulic cylinder according to the first embodiment of the invention.

In contrast, as illustrated in FIGS. 1 and 2, the hydraulic cylinder 100 includes the annular bushing 60 provided on the inner circumference of the cylinder head 40 to slidably support the piston rod 20, and the annular housing recessed portion 50 formed on the inner circumference of the cylinder head 40 to receive the bushing 60 forcibly inserted. Meanwhile, the hydraulic cylinder 100 has no grease reserving groove 551.

The bushing 60 is forcibly inserted to the housing recessed portion 50 from the inlet portion 50A opened to the rod-side chamber 2. As illustrated in FIG. 2, the housing recessed portion 50 has a cylindrical forcible insertion portion 52 as an inner circumferential surface of the cylinder head 40 where the bushing 60 is forcibly inserted, and a bottom face 53 perpendicular to the center axis of the cylinder head 40. That is, the housing recessed portion 50 is an annular concave portion having a rectangular cross section. By forming the housing recessed portion 50 in a rectangular cross-sectional shape, it is possible to more easily perform fabrication.

As illustrated in FIG. 2, the bushing 60 is formed to have a total axial length shorter than a total axial length of the housing recessed portion 50. The bushing 60 is forcibly inserted by using a forcible insertion tool (not shown) for adjusting a forcible insertion length until an end face opposite to the rod-side chamber 2 substantially matches an end face of the cylinder head 40. For this reason, a bottom clearance 51 is formed between the bushing 60 and the bottom face 53 of the housing recessed portion 50.

The grease 70 as a lubricant material is filled in the bottom clearance 51 of the bottom portion of the housing recessed portion 50 (refer to FIG. 1). As the grease 70 is filled in the inner side of the cylinder head 40, a lubricating film is formed on the outer circumference of the piston rod 20, so that the piston rod 20 smoothly slides. Note that the grease 70 is not illustrated in FIG. 2.

The lubricant material may be, for example, an impregnant material obtained by impregnating grease or the like. The lubricant material may be formed of any material that can form a lubricating film on the outer circumference of the piston rod 20 to improve lubricity of the piston rod 20. In addition, a grease nipple for filling the grease 70 in the bottom clearance 51 may be provided in the cylinder head 40.

In this manner, since the grease 70 is filled in the bottom clearance 51 between the bushing 60 and the bottom face 53 of the housing recessed portion 50, it is not necessary to independently form the grease reserving groove 551 for filling the grease 70 on the inner circumference of the cylinder head 40.

The bottom clearance 51 can be easily formed by increasing a depth of the housing recessed portion 50 having a rectangular cross section or shortening the length of the bushing 60 on the contrary.

According to the embodiment described above, the following effects can be obtained.

In the hydraulic cylinder 100, the grease 70 is filled in the bottom clearance 51 between the housing recessed portion 50 and the bushing 60. For this reason, it is not necessary to independently form the grease reserving groove 551 for filling the grease 70 on the inner circumference of the cylinder head 40. Therefore, it is possible to improve producibility in the hydraulic cylinder 100.

Next, second to fifth embodiments of the invention will now be described with reference to FIGS. 3 to 6. Note that the grease 70 is not illustrated intentionally in FIGS. 3 to 6.

<Second Embodiment>

A hydraulic cylinder 200 according to a second embodiment of the invention will be described with reference to FIG. 3. In the following description, the description will be made by focusing on differences from the first embodiment, and like reference numerals denote like elements as in the hydraulic cylinder 100 of the first embodiment and will not be described repeatedly.

In the first embodiment described above, the housing recessed portion 50 is an annular rectangular cross-sectional concave portion having a bottom face 53 perpendicular to the central axis of the cylinder head 40. In contrast, unlike the first embodiment, a housing recessed portion 150 of the hydraulic cylinder 200 has a forcible insertion portion 152 as an inner circumferential surface of the cylinder head 40 where the bushing 60 is forcibly inserted, a step portion 154 formed perpendicularly to the center axis of the cylinder head 40 to serve as an abutting portion where the end face of the bushing 60 abuts, and a cylindrical gap partitioning portion 155 formed toward the bottom face 153 from the inner side of the step portion 154 in the radial direction to partition the bottom clearance 151.

Figure 3:
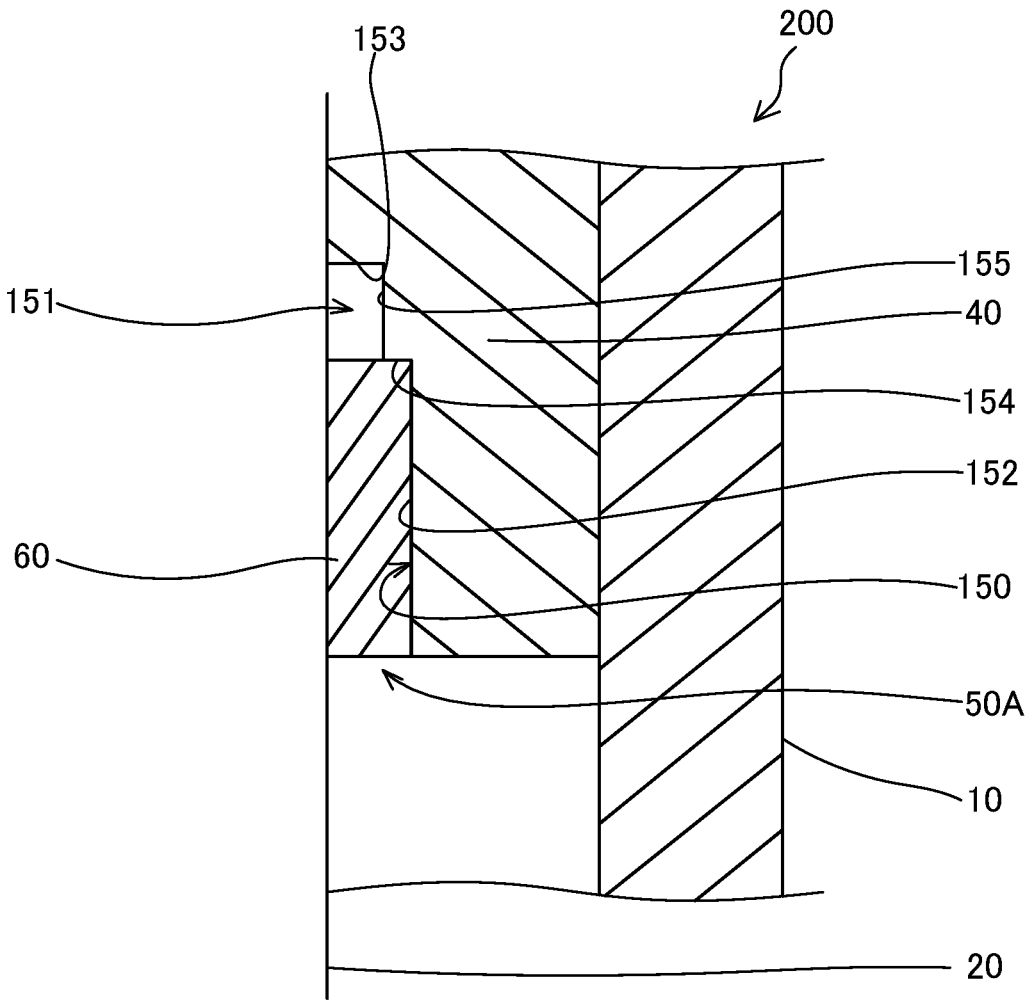
FIG. 3 is a cross-sectional view illustrating a bushing and a housing recessed portion of a hydraulic cylinder according to a second embodiment of the invention.

As illustrated in FIG. 3, in the hydraulic cylinder 200, the bushing 60 is forcibly inserted to the forcible insertion portion 152 until it abuts on the step portion 154. In this manner, a forcible insertion length of the bushing 60 toward the housing recessed portion 150 is defined by the step portion 154. The bottom clearance 151 where the grease 70 is filled is partitioned by the end face of the bushing 60 abutting on the step portion 154, the bottom face 153 of the housing recessed portion 150, and the gap partitioning portion 155.

The gap partitioning portion 155 is formed in a cylindrical surface shape having an inner diameter smaller than that of the forcible insertion portion. Note that the gap partitioning portion 155 is not limited to the cylindrical surface shape, and may be formed in other shapes such as a tapered shape or a curved shape.

According to the second embodiment described above, it is possible to obtain the following effect as well as the same effects as those of the first embodiment.

Since the housing recessed portion 150 of the hydraulic cylinder 200 has the step portion 154, the forcible insertion length of the bushing 60 toward the housing recessed portion 150 is defined by the step portion 154. Therefore, it is possible to form the bottom clearance 151 in the bottom portion side of the housing recessed portion 150 without using the forcible insertion tool. Therefore, it is possible to improve assemblability of the hydraulic cylinder 200.

<Third Embodiment>

Next, a hydraulic cylinder 300 according to a third embodiment of the invention will be described with reference to FIG. 4. In the following description, the description will be made by focusing on differences from the second embodiment, and like reference numerals denote like elements as in the hydraulic cylinder 200 of the second embodiment and will not be described repeatedly.

According to the second embodiment, the housing recessed portion 150 has the step portion 154 serving as the abutting portion perpendicular to the center axis. In contrast, unlike the second embodiment, a housing recessed portion 250 of the hydraulic cylinder 300 has a forcible insertion portion 252 having a cylindrical surface shape which is the inner circumferential surface of the cylinder head 40 where the bushing 60 is forcibly inserted, and a bottom face 253 formed in a tapered shape in which its inner diameter gradually increases along the axial direction, and a boundary portion 253A between the forcible insertion portion 252 and the bottom face 253 serves as the abutting portion.

Figure 4:
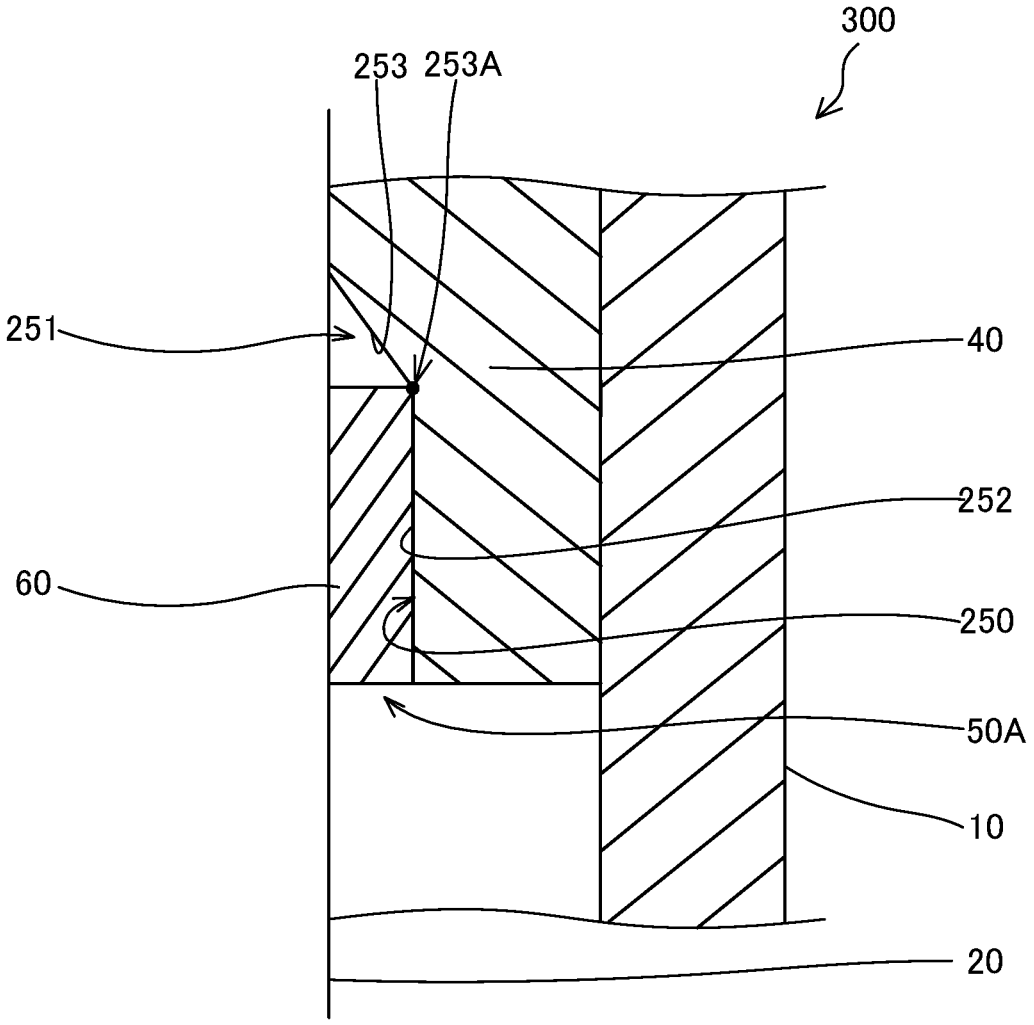
FIG. 4 is a cross-sectional view illustrating a bushing and a housing recessed portion of a hydraulic cylinder according to a third embodiment of the invention.

As illustrated in FIG. 4, the housing recessed portion 250 has a forcible insertion portion 252 having a cylindrical surface shape which is the inner circumferential surface of the cylinder head 40 where the bushing 60 is forcibly inserted, and a bottom face 253 having a tapered shape in which its inner diameter gradually increases toward the inlet portion 50A side along the axial direction. Note that the bottom face 253 is not limited to the tapered shape and may be formed in other shapes such as a curved shape as long as the inner diameter gradually increases toward the inlet portion 50A side.

The bushing 60 is forcibly inserted to the forcible insertion portion 252 until it abuts on a boundary portion 253A with the forcible insertion portion 252 on the bottom face 253 of the housing recessed portion 250. In this manner, the boundary portion 253A adjoining with the forcible insertion portion 252 on the bottom face 253 serves as the abutting portion that defines a forcible insertion length of the bushing 60 to the housing recessed portion 250. Since the bottom face 253 of the housing recessed portion 250 is formed in a tapered shape, a bottom clearance 251 is formed between the end face of the bushing 60 and the bottom face 253 of the housing recessed portion 250. Similar to the first embodiment, the grease 70 is filled in the bottom clearance 251.

According to the third embodiment described above, it is possible to obtain the following effects.

In the hydraulic cylinder 300, the bottom face 253 of the housing recessed portion 250 is formed in a tapered shape. Therefore, the bushing 60 abuts on the boundary portion 253A between the forcible insertion portion 252 of the housing recessed portion 250 and the bottom face 253. In this manner, the forcible insertion length of the bushing 60 to the housing recessed portion 250 is defined by the boundary portion 253A. Therefore, it is possible to form the bottom clearance 151 between the housing recessed portion 150 and the bottom face 153 without adjusting the forcible insertion length of the bushing 60 using the forcible insertion tool. Therefore, it is possible to improve assemblability of the hydraulic cylinder 200.

<Fourth Embodiment>

Next, a hydraulic cylinder 400 according to a fourth embodiment of the invention will be described with reference to FIG. 5. In the following description, the description will be made by focusing on differences from the first embodiment, and like reference numerals denote like elements as in the hydraulic cylinder 100 of the first embodiment and will not be described repeatedly.

Unlike the first embodiment, a housing recessed portion 350 of the hydraulic cylinder 400 has a forcible insertion portion 352 which is the inner circumferential surface of the cylinder head 40 where the bushing 60 is forcibly inserted, and a large diameter portion 354 formed between the forcible insertion portion 352 and the bottom face 353 with an inner diameter larger than that of the forcible insertion portion 352 to partition the bottom clearance 351.

Figure 5:
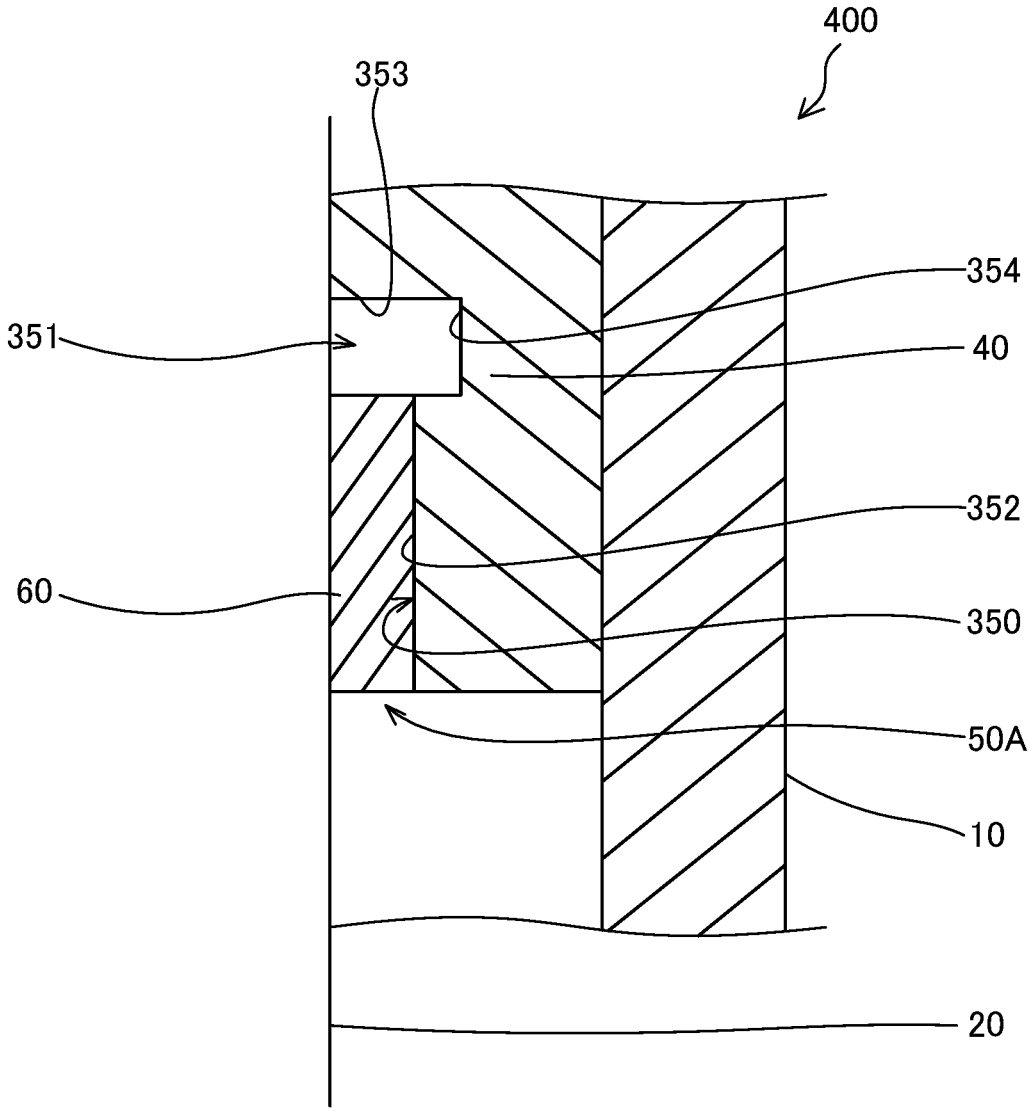
FIG. 5 is a cross-sectional view illustrating a bushing and a housing recessed portion of a hydraulic cylinder according to a fourth embodiment of the invention.

As illustrated in FIG. 5, the large diameter portion 354 of the housing recessed portion 350 is formed in a cylindrical surface shape having an inner diameter larger than that of the forcible insertion portion 352. The bottom clearance 351 for filling the grease 70 is formed by the bottom face 353 of the housing recessed portion 350, the large diameter portion 354, and the end face of the bushing 60.

Note that the bottom face 353 may be formed to have an inner diameter gradually increasing toward the inlet portion 50A side, and may be formed in other shapes such as a tapered shape or a curved shape. In addition, the large diameter portion 354 is not limited to the cylindrical surface shape, and may be formed in other shapes such as a tapered shape or a curved shape. In addition, similar to the second embodiment, the abutting portion where the bushing 60 abuts may be provided between the forcible insertion portion 352 and the large diameter portion 354.

According to the fourth embodiment described above, it is possible to obtain the following effects as well as the same effects as those of the first embodiment.

In the hydraulic cylinder 400, the housing recessed portion 350 has the large diameter portion 354 formed to have an inner diameter larger than that of the forcible insertion portion 352. Therefore, it is possible to increase a volume of the bottom clearance 351. Therefore, it is possible to increase the amount of the grease 70 filled in the bottom clearance 351.

<Fifth Embodiment>

Next, a hydraulic cylinder 500 according to a fifth embodiment of the invention will be described with reference to FIG. 6. In the following description, the description will be made by focusing on differences from the first embodiment, and like reference numerals denote like elements as in the hydraulic cylinder 100 of the first embodiment and will not be described repeatedly.

In the hydraulic cylinder 100, the bushing 60 formed of metal is forcibly inserted to the forcible insertion portion 52 of the housing recessed portion 50 and is fixed to the cylinder head 40. Instead, in the hydraulic cylinder 500, the bushing 460 formed of a resin material that can be expanded or contracted by an external force is locked to the positioning portion 454 of the housing recessed portion 450 so as to be installed in the cylinder head 40.

Figure 6:
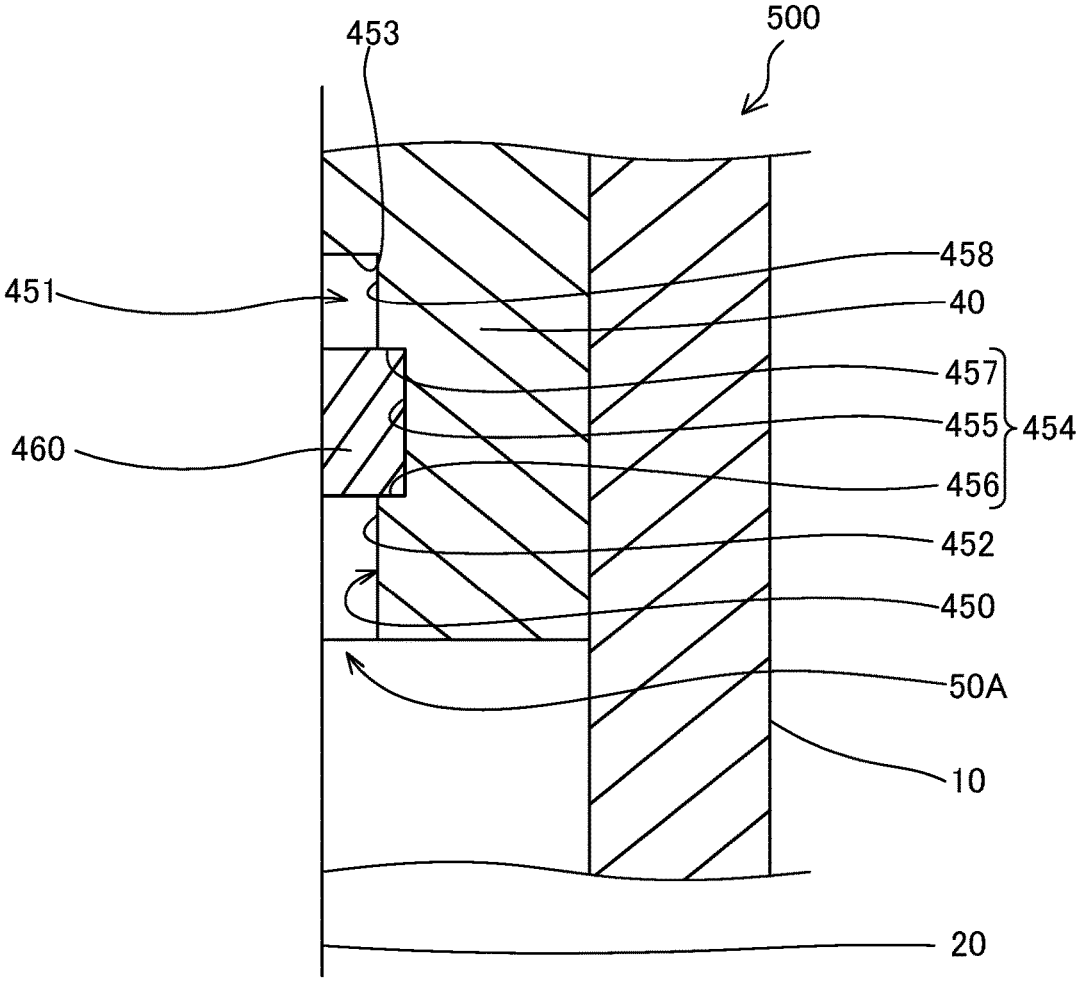
FIG. 6 is a cross-sectional view illustrating a bushing and a housing recessed portion of a hydraulic cylinder according to fifth embodiment of the invention.

As illustrated in FIG. 6, the housing recessed portion 450 of the hydraulic cylinder 500 has an introducing portion 452 formed from the inlet portion 50A, a positioning portion 454 provided between the introducing portion 452 and the bottom face 453 to lock and position the bushing 460 in the axial direction, and a clearance-forming portion 458 provided between the positioning portion 454 and the bottom face 453 to partition the bottom clearance 451.

The positioning portion 454 has an installation cylindrical surface 455 formed to have an inner diameter larger than the inner diameter of the introducing portion 452 and slightly smaller than the outer diameter of the bushing 460, a first side surface 456 that connects the installation cylindrical surface 455 and the introducing portion 452 and is perpendicular to the center axis, and a second side surface 457 that connects the installation cylindrical surface 455 and the clearance-forming portion 458 and is perpendicular to the center axis.

The introducing portion 452 and the clearance-forming portion 458 are formed as a cylindrical surface having an inner diameter smaller than the outer diameter of the bushing 460 and the inner diameter of the installation cylindrical surface 455 of the positioning portion 454.

In order to install the bushing 460 in the housing recessed portion 450, first, the bushing 460 is inserted into the introducing portion 452 while it is elastically deformed by an external force to reduce the outer diameter.

As the bushing 460 is inserted into the positioning portion 454, the outer diameter of the bushing 460 that has been elastically deformed is returned to its original shape, so that the outer diameter of the bushing 460 becomes substantially equal to the inner diameter of the installation cylindrical surface 455. As a result, an axial movement of the bushing 460 is restricted by the first and second side walls 456 and 457 of the positioning portion 454 and is locked to the positioning portion 454. As a result, the bushing 460 is installed in the housing recessed portion 450 while its release from the housing recessed portion 450 is restricted. In this manner, unlike the first embodiment, the bushing 460 may not be forcibly inserted to and fixed to the housing recessed portion 450. Instead, it may be installed in the housing recessed portion 450 while its axial movement is restricted as in the fifth embodiment.

As the bushing 460 is locked to the positioning portion 454 and is installed in the housing recessed portion 450, the bottom clearance 451 for filling the grease 70 is formed by the bottom face 453 of the housing recessed portion 450, the clearance-forming portion 458, and the end face of the bushing 460.

Note that, although the bushing 460 is formed of a resin material that can be relatively easily elastically deformed in the fifth embodiment, the bushing 460 may be formed of other materials without limiting to the resin material.

According to the fifth embodiment described above, it is possible to obtain the following effect in addition to the same effects as those of the first embodiment.

In the hydraulic cylinder 500, the bushing 460 is formed of a resin material that can be relatively easily deformed by an external force and is installed in the cylinder head 40 as it is locked to the positioning portion 454 of the housing recessed portion 450. For this reason, compared to a case where a metal bushing is forcibly inserted, it is possible to easily install the bushing 460 in the cylinder head 40 and reduce man-hours for the assembly work.

Configurations, functions, and effects of the embodiments of the invention will now be described in summary.

The single-acting hydraulic cylinder 100, 200, 300, 400, 500 includes a cylinder tube 10 having a bottomed cylindrical shape and an opening 10A provided in one end, a piston rod 20 inserted into the cylinder tube 10, a piston 30 connected to a tip of the piston rod 20 to partition an inside of the cylinder tube 10 into a rod-side chamber 2 filled with a gas and a bottom-side chamber 3 where a hydraulic fluid is supplied or discharged, a cylinder head 40 provided in the opening 10A of the cylinder tube to allow the piston rod 20 to be inserted, a bushing 60 provided on an inner circumference of the cylinder head 40 to slidably support the piston rod 20, and a housing recessed portion 50, 150, 250, 350, 450 formed on the inner circumference of the cylinder head 40 to receive the bushing 60 460 forcibly inserted from the inlet portion 50A, wherein the bottom clearance 51, 151, 251, 351, 451 filled with the grease 70 is formed between the bottom face 53, 153, 253, 353, 453 of the housing recessed portion 50, 150, 250, 350, 450 and the bushing 60, 460.

The housing recessed portion 50 of the single-acting hydraulic cylinder 100 is formed in a rectangular cross-sectional shape having a forcible insertion portion 52 and a bottom face 53 perpendicular to a center axis of the cylinder head 40. The forcible insertion portion 52 is the inner circumferential surface of the cylinder head 40 where the bushing 60 is forcibly inserted.

In this configuration, the grease 70 is filled in the bottom clearance 51, 151, 251, 351, 451 between the housing recessed portion 50, 150, 250, 350, 450 where the bushing 60, 460 is installed and the bushing 60, 460. For this reason, it is not necessary to form a groove for filling the grease 70 on the inner circumference of the cylinder head 40. Therefore, it is possible to improve producibility of the single-acting hydraulic cylinders 100, 200, 300, 400, 500.

The single-acting hydraulic cylinder 200, 300 has the abutting portion (the step portion 154 and the boundary portion 253A) where the bushing 60 abuts on the housing recessed portion 150, 250.

The housing recessed portion 150 of the single-acting hydraulic cylinder 200 has the forcible insertion portion 152 which is the inner circumferential surface of the cylinder head 40 where the bushing 60 is forcibly inserted, and the abutting portion is the step portion 154 formed perpendicularly to the center axis from the forcible insertion portion 152.

The housing recessed portion 250 of the single-acting hydraulic cylinder 300 has the forcible insertion portion 252 which is the inner circumferential surface of the cylinder head 40 where the bushing 60 is forcibly inserted, and the bottom face 253 formed to have an inner diameter gradually increasing toward the inlet portion 50A.

In the single-acting hydraulic cylinder 300, the boundary portion 253A between the forcible insertion portion 252 and the bottom face 253 serves as the abutting portion.

In this configuration, the forcible insertion length of the bushing 60 toward the housing recessed portion 150, 250 is defined by the abutting portion (the step portion 154 and the boundary portion 253A). Therefore, the bottom clearance 151, 251 is formed in the bottom portion of the housing recessed portion 150, 250 without adjusting the forcible insertion length of the bushing 60. Therefore, it is possible to improve assemblability of the hydraulic cylinders 200, 300.

The housing recessed portion 350 of the single-acting hydraulic cylinder 400 has the forcible insertion portion 352 which is the inner circumferential surface of the cylinder head 40 where the bushing 60 is forcibly inserted, and a large diameter portion 354 formed between the forcible insertion portion 352 and the bottom face 353 to partition the bottom clearance 351. The large diameter portion 354 has an inner diameter larger than that of the forcible insertion portion 352.

In this configuration, it is possible to increase a volume of the bottom clearance 351 where the grease 70 is filled. Therefore, it is possible to increase the filling amount of the grease 70.

In the single-acting hydraulic cylinder 500, the bushing 460 is formed expandably/contractably by an external force in a radial direction, and the housing recessed portion 450 has the introducing portion 452 formed from the inlet portion 50A and provided with an inner diameter smaller than the outer diameter of the bushing 460, the positioning portion 454 provided between the introducing portion 452 and the bottom face 453 to lock and position the bushing 460 in the axial direction, and a clearance-forming portion 458 formed between the positioning portion 454 and the bottom face 453 to partition the bottom clearance 451.

In this configuration, the bushing 460 is relatively easily deformed by an external fore and is locked to the positioning portion 454 of the housing recessed portion 450 for installation to the cylinder head 40. For this reason, compared to a case where a bushing formed of metal is forcibly inserted, it is possible to easily install the bushing 460 in the cylinder head 40 and reduce man-hours for the assembly work.

The single-acting hydraulic cylinders 100, 200, 300, 400, 500 are lift cylinders for lifting or lowering a fork of a forklift.

Embodiments of this invention were described above, but the above embodiments are merely examples of applications of this invention, and the technical scope of this invention is not limited to the specific constitutions of the above embodiments.

Although the hydraulic fluid is employed as an actuating liquid in each of the aforementioned embodiments, for example, a water-soluble alternative liquid may also be employed instead.

Although the hydraulic cylinder 100, 200, 300, 400, 500 is employed as a lift cylinder for lifting a load of the forklift in each of the aforementioned embodiments, they may also be employed in various fields other than the lift cylinder.

This application claims priority based on Japanese Patent Application No. 2015-58144 filed with the Japan Patent Office on Mar. 20, 2015, the entire contents of which are incorporated into this specification.

The invention claimed is:

1. A single-acting hydraulic cylinder comprising:

a cylinder tube having a bottomed cylindrical shape provided with an opening in one end;

a piston rod inserted into the cylinder tube;

a piston connected to a tip of the piston rod, the piston partitioning an inside of the cylinder tube into a rod-side chamber and a bottom-side chamber, a gas being filled in the rod-side chamber, an actuating liquid being supplied to or discharged from the bottom-side chamber;

a cylinder head provided in the opening of the cylinder tube to allow the piston rod to be inserted;

a bushing installed on an inner circumference of the cylinder head to slidably support the piston rod; and a housing recessed portion formed on the inner circumference of the cylinder head to allow the bushing to be inserted from an inlet portion, and a main seal provided on the inner circumference of the cylinder head, the main seal being in sliding contact with an outer circumferential surface of the piston rod to seal the rod-side chamber, wherein a bottom clearance filled with a lubricant material is formed between a bottom face of the housing recessed portion and the bushing, and the bottom clearance is provided in the rod-side chamber side relative to the main seal.

2. The single-acting hydraulic cylinder according to claim 1, wherein the housing recessed portion is formed in a rectangular cross-sectional shape having a forcible insertion portion and the bottom face perpendicular to a center axis of the cylinder head, the forcible insertion portion being an inner circumferential surface of the cylinder head into which the bushing is forcibly inserted.

3. The single-acting hydraulic cylinder according to claim 1, wherein the housing recessed portion has an abutting portion on which the bushing abuts.

4. The single-acting hydraulic cylinder according to claim 3, wherein the housing recessed portion has a forcible insertion portion which is an inner circumferential surface of the cylinder head into which the bushing is forcibly inserted, and the abutting portion is a step portion formed perpendicularly to the center axis from the forcible insertion portion.

5. The single-acting hydraulic cylinder according to claim 3, wherein the bottom face of the housing recessed portion is formed to have an inner diameter gradually increasing toward the inlet portion.

6. The single-acting hydraulic cylinder according to claim 1, wherein the housing recessed portion has:

a forcible insertion portion which is an inner circumferential surface of the cylinder head into which the bushing is forcibly inserted; and a large diameter portion formed between the forcible insertion portion and the bottom face to partition the bottom clearance, the large diameter portion having an inner diameter larger than that of the forcible insertion portion.

7. The single-acting hydraulic cylinder according to claim 1, wherein the bushing is formed expandably/contractably in a radial direction by an external force, and the housing recessed portion has:

an introducing portion formed from the inlet portion and provided with an inner diameter smaller than an outer diameter of the bushing;

a positioning portion provided between the introducing portion and the bottom face to lock and position the bushing in an axial direction; and a clearance-forming portion formed between the positioning portion and the bottom face to partition the bottom clearance.

8. The single-acting hydraulic cylinder according to claim 1, wherein the single-acting hydraulic cylinder is a lift cylinder that lifts or lowers a fork of a forklift.

9. A single-acting hydraulic cylinder comprising:

a cylinder tube having a bottomed cylindrical shape provided with an opening in one end;

a piston rod inserted into the cylinder tube;

a piston connected to a tip of the piston rod, the piston partitioning an inside of the cylinder tube into a rod-side chamber and a bottom-side chamber, a gas being filled in the rod-side chamber, an actuating liquid being supplied to or discharged from the bottom-side chamber;

a cylinder head provided in the opening of the cylinder tube to allow the piston rod to be inserted;

a bushing installed on an inner circumference of the cylinder head to slidably support the piston rod; and a housing recessed portion formed on the inner circumference of the cylinder head to allow the bushing to be inserted from an inlet portion, wherein a bottom clearance filled with a lubricant material is formed between a bottom face of the housing recessed portion and the bushing, and the bushing is provided in the rod-side chamber side relative to the bottom clearance.

10. The single-acting hydraulic cylinder according to claim 9, wherein the housing recessed portion is formed in a rectangular cross-sectional shape having a forcible insertion portion and the bottom face perpendicular to a center axis of the cylinder head, the forcible insertion portion being an inner circumferential surface of the cylinder head into which the bushing is forcibly inserted.

11. The single-acting hydraulic cylinder according to claim 9, wherein the housing recessed portion has an abutting portion on which the bushing abuts.

12. The single-acting hydraulic cylinder according to claim 11, wherein the housing recessed portion has a forcible insertion portion which is an inner circumferential surface of the cylinder head into which the bushing is forcibly inserted, and the abutting portion is a step portion formed perpendicularly to the center axis from the forcible insertion portion.

13. The single-acting hydraulic cylinder according to claim 11, wherein the bottom face of the housing recessed portion is formed to have an inner diameter gradually increasing toward the inlet portion.

14. The single-acting hydraulic cylinder according to claim 9, wherein the housing recessed portion has:

a forcible insertion portion which is an inner circumferential surface of the cylinder head into which the bushing is forcibly inserted; and a large diameter portion formed between the forcible insertion portion and the bottom face to partition the bottom clearance, the large diameter portion having an inner diameter larger than that of the forcible insertion portion.

15. The single-acting hydraulic cylinder according to claim 9, wherein the bushing is formed expandably/contractably in a radial direction by an external force, and the housing recessed portion has:

an introducing portion formed from the inlet portion and provided with an inner diameter smaller than an outer diameter of the bushing;

a positioning portion provided between the introducing portion and the bottom face to lock and position the bushing in an axial direction; and a clearance-forming portion formed between the positioning portion and the bottom face to partition the bottom clearance.

16. The single-acting hydraulic cylinder according to claim 9, wherein the single-acting hydraulic cylinder is a lift cylinder that lifts or lowers a fork of a forklift.

* * * * *